US005676259A

United States Patent [19]

Charchaflian et al.

[11] Patent Number: 5,676,259

[45] Date of Patent: Oct. 14, 1997

[54] BOOT STORAGE AND RETRIEVAL SYSTEM

[75] Inventors: Michael Charchaflian, Worcester, Mass.; Eric Rasmussen, Manchester, N.H.

[73] Assignee: Automation & Information Planners Inc., Worcester, Mass.

[21] Appl. No.: 517,000

[22] Filed: Aug. 18, 1995

[51] Int. Cl.[6] ..... A47F 7/08

[52] U.S. Cl. ..... 211/34; 211/37; 211/35; 211/162

[58] Field of Search ..... 211/34, 35, 36, 211/37, 94.5, 162, 94; 12/125.5

[56] References Cited

U.S. PATENT DOCUMENTS

| | | | |
|---|---|---|---|
| 2,606,666 | 8/1952 | Gray | 211/94.5 X |
| 2,690,136 | 9/1954 | Freeman | 211/162 X |
| 3,069,020 | 12/1962 | Sans | 211/162 |
| 3,081,023 | 3/1963 | Taylor | 211/189 X |
| 3,606,948 | 9/1971 | Strang | 211/162 X |
| 3,897,122 | 7/1975 | McEvers | 211/94 X |
| 4,008,807 | 2/1977 | Phillips | 211/162 X |
| 4,008,932 | 2/1977 | Wildschut | 211/194 X |
| 4,095,858 | 6/1978 | Hopf | 211/194 X |
| 4,175,807 | 11/1979 | Kranich et al. | 211/194 X |
| 4,200,993 | 5/1980 | Blanc et al. | 211/34 X |
| 5,224,611 | 7/1993 | Phillipson et al. | 211/126 X |
| 5,284,257 | 2/1994 | Schum | 211/94 X |

FOREIGN PATENT DOCUMENTS

| | | | |
|---|---|---|---|
| 2537857 | 6/1984 | France | 211/37 |
| 2154563 | 9/1985 | United Kingdom | 211/162 |

*Primary Examiner*—Leslie A. Braun
*Assistant Examiner*—Sandra Snapp
*Attorney, Agent, or Firm*—William Nitkin

[57] ABSTRACT

A system for the storage and retrieval of pairs of boots utilizing a plurality of chutes, each having a diamond-shape cross section, with the chutes arranged in a honeycomb fashion, each chute having a carriage assembly disposed along the length of its inner apex. A plurality of hangers are provided, each having a pair of upwardly extending arms on which such pairs of boots can be mounted upside down with the hanger slideably and removably engaged to the carriage assembly. The chutes are disposed at a downward angle so that a pair of boots mounted on a hanger entered from the rear end of a chute will advance by gravity toward the front end of the chute where it can be removed when needed. An optional heating unit can be disposed on the bottom of each chute to speed up the drying time of the boots if such boots are wet.

3 Claims, 2 Drawing Sheets

BOOT STORAGE AND RETRIEVAL SYSTEM

BACKGROUND OF THE INVENTION

1. Field of the Invention

The system of this invention resides in the area of boot storage and retrieval systems and more particularly relates to a plurality of downwardly disposed chutes, each having a carriage assembly disposed within each chute along its top length on which move a plurality of hangers, each hanger having two upwardly disposed arms for the mounting of a pair of boots in an inverted position thereon.

2. Description of the Prior Art

A problem in the rental of ski boots at ski resorts has been the storage and drying of wet ski boots when they are returned at the end of the day. Storing such wet ski boots on shelves overnight often does not provide sufficient time for such boots to dry thoroughly. Damp boots, if rented, are uncomfortable to wear and promote the spread of unwanted foot diseases such as athlete's foot. To address this problem, Blanc et al in U.S. Pat. No. 4,200,993 places such boots individually on uprightly disposed tubular pegs on a rack through which hot air is directed, helping the boot to dry out and allowing drainage of any water. Each rack can hold a number of boots depending on the number of pegs that extend upward therefrom. To utilize this prior art system successfully, one must have both a place to dispose such racks which racks can be on wheels to move them and means to systematize and maintain the boots in pairs for easy retrieval.

SUMMARY OF THE INVENTION

It is an object of this invention to provide an improved ski boot storage, retrieval and drying system for ski resorts where ski boots are rented on a daily basis. The storage and retrieval system of this invention can also be utilized by other large-volume distributors of boots such as ski equipment manufacturers.

It is a further object of this invention that it provide a compact structure and an ability to group boots in pairs for fast and easy retrieval to eliminate the need for space-wasting aisles, shelves or other types of movable storage racks. In the system of this invention, the pairs of boots in the system of this invention are stored upside down to allow them to drain by gravity to decrease their drying time. Further the system of this invention reduces the amount of labor needed for the storage and retrieval of boots as the system employs a first-in/first-out storage and retrieval method which provides for maximum drying time per pair of boots and also evens out the time the boots are used based on when they are returned, for example, the first returned one day being the first used the next day. The system of this invention further has the advantage of grouping boots not only by pairs on a hanger but also grouping by individual boot size with each boot size being disposed, for example, in a separate chute. The force of gravity advances the hangers with pairs of boots thereon through the individual chutes, eliminating the need for electric power. A piped-air drying system can be optionally used within the chutes to decrease the drying out time of any wet ski boots.

In a preferred embodiment of the system of this invention a plurality of chutes, each chute having a diamond-shaped cross-section and an elongated passage, is provided. Within each chute is disposed along its inner apex a fixed carriage assembly formed of a rail member having a rail channel defined along its length. A plurality of hangers is provided, each formed of a top portion and a bottom portion with a vertical support member disposed therebetween and with two support arms extending upward from the bottom portion of each hanger with the top portion adapted to slideably move within the rail channel defined in the carriage assembly. Each diamond-shaped chute is disposed at the same downwardly sloped angle and is of a length to receive a plurality of hangers with pairs of boots mounted on the arms of such hanger. As each pair of rented boots is returned, it is placed on a hanger's arms and re-entered at the rear of the appropriate size-designated chute on the carriage assembly and advances down the chute until the hanger reaches the front of the chute where a stop member prevents the hanger from falling out of the chute or is stopped by contact with a previously stored pair of boots within the chute. A plurality of such diamond-shaped chutes can be joined to one another to form an elongated honeycomb-like structure which chutes fit compactly together because of their individual nested diamond shapes.

In using the system of this invention the individual dispensing the boots lifts the hanger on which the desired pair of boots is mounted off the carriage assembly and out the front end of the chute and then removes the boots from the hanger arms on which they were placed upside down and hands them out to the user. Each chute can be designated to receive, store and dispense specific sized boots. The hangers taken out of the front of one chute can be returned to the rear of the storage unit for reuse by mounting another pair of boots thereon. The hanger with boots mounted on its arms is placed with its upper portion riding in the rail channel of the carriage assembly within the chute from the rear of the appropriate chute for that size boot so that it will advance down the rail channel toward the front of the chute where the dispensing individual is located. The chutes are disposed at a downward angle with the rear end of each chute is higher than its front end so that the hangers advance easily by gravity-down the rail channels of the carriage assemblies. A roller member located in the top portion of each hanger can engage into the rail channel of the carriage assembly to facilitate such downward movement.

DESCRIPTION OF THE PREFERRED EMBODIMENT(S)

Figure 1:
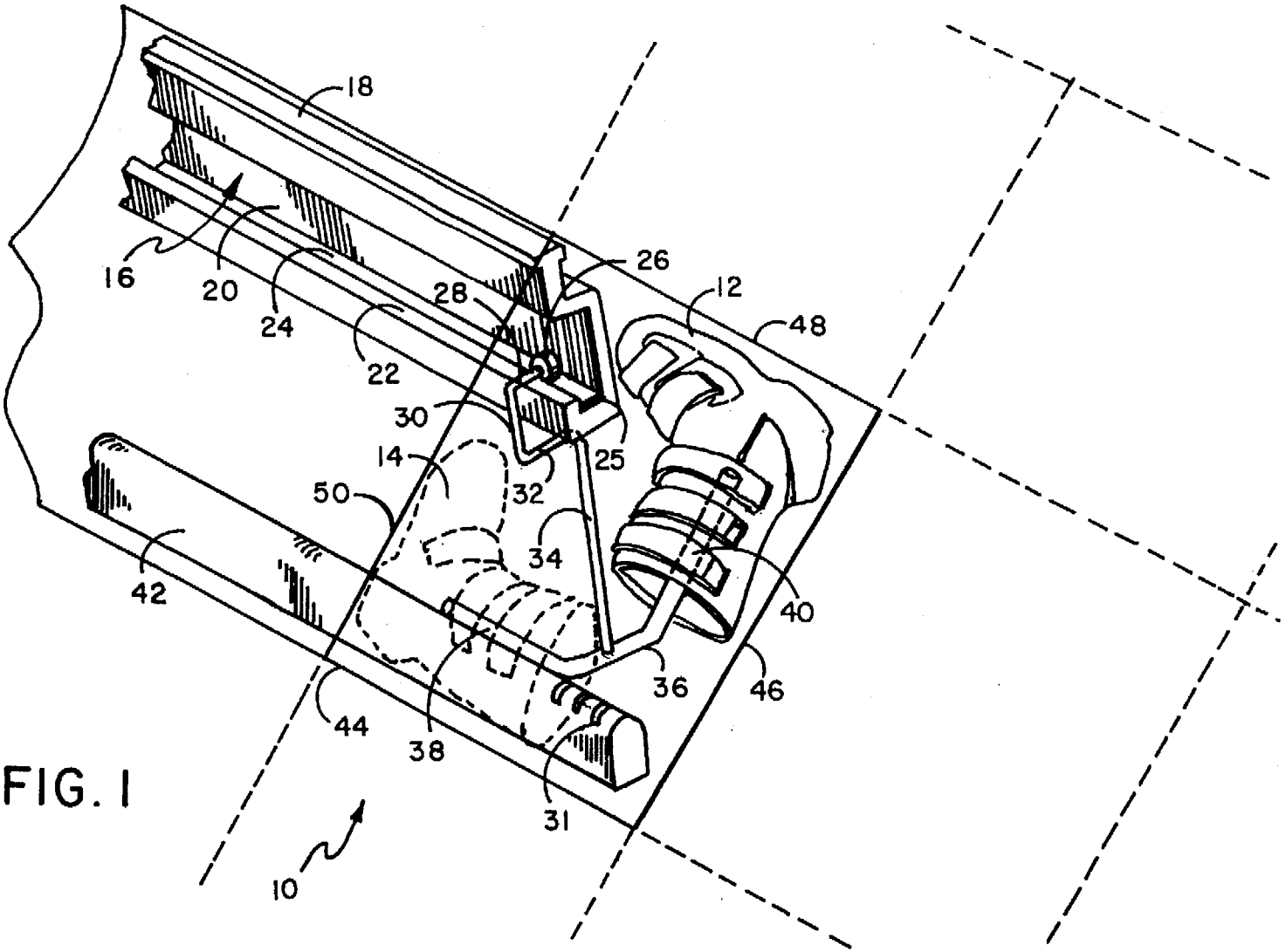
FIG. 1 illustrates a perspective sectional front view of a chute, showing the carriage assembly with a hanger supporting a pair of boots advanced to its foremost position.
Figure 2:
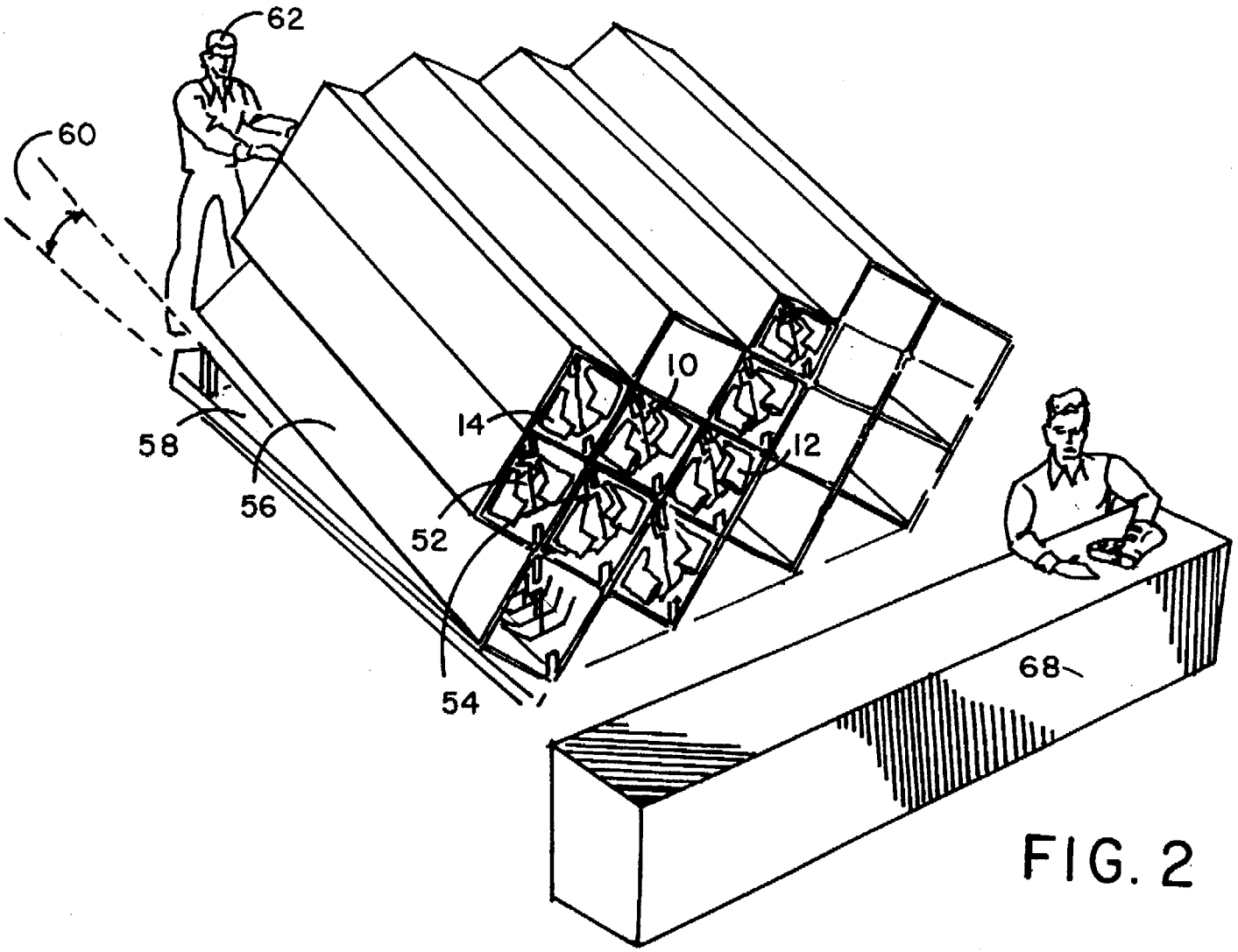
FIG. 2 illustrates a perspective view of a plurality of chutes being higher at their rear ends showing the system of this invention in use with an individual in the rear entering hangers with boots mounted thereon in the proper chutes and an individual in the front dispensing boots.

FIG. 1 illustrates a typical chute 10 utilized in the preferred embodiment of the system of this invention. Chute 10 is diamond-shaped in cross-section and is disposed adjacent to a plurality of other similar chutes seen in outline form. The system can utilize as many chutes as necessary to accomplish the goals of this invention. Each chute is composed of four rearwardly extending side walls 44, 46, 48 and 50 and has a fixed length such as seen in FIG. 2. Inside the top apex of each chute is disposed carriage assembly 11. Hanger 9 is slideably and removably installed in carriage assembly 11. FIG. 1 shows hanger 9 advanced to its foremost position at the front end of the chute. One embodiment of carriage assembly 11 can have rail member 16 which can be attached by one of many well-known means of attachment at its rail top 18 to the inner top apex of the diamond-shaped chute between first upper side wall 50 and second upper side wall 48. Defined within rail member 16 is rail channel 24 formed by rail shoulder 22 and rail side 20. Movable within rail channel 24 is the top portion of hanger member 9 which utilizes a roller 26 which rests in a rotatable and movable fashion within rail channel 24. Located beneath the top portion of hanger 9 is elongated support member 34 attached thereto by an outward extension 32 which, in turn, is attached to an upright member 30 and an inward extension 28 on which roller 26 is rotatably mounted. Outward extension 32, upright member 30 and inward extension 28 extend around rail shoulder 22 to allow roller 26 to roll by gravity within rail channel 24. Thus hanger 9, if placed at the rear of downwardly angled chute 10 will roll by gravity from the rear to the front of the chute where stop member 25 can be provided to prevent the hanger from passing out the front opening of the chute. Elongated support member 34 extends downward to the bottom portion of hanger 9 composed of arm junction 36 on which first arm 38 and second arm 40, aligned in the same plane, extend respectively at upward angles with first arm 38 disposed substantially parallel to first lower side wall 46 and second arm 40 disposed substantially parallel to second lower side wall 44 of chute 10. On first arm 38 and second arm 40 is disposed a pair of upside down boots such as first boot 12 and second boot 14, herein shown in outline form with the toes of both boots aimed upward and inward toward carriage assembly 11. The boots are disposed so that any liquid therein will drain out of them and fall to the bottom of the chute and out the front opening of the chute. A plurality of hangers, each with a pair of boots mounted thereon, can advance down the rail channel of each carriage assembly with each hanger supported by its roller 26 within rail channel 24, rolling by gravity to strike a small stop member 25 which blocks the front of rail channel 24 to prevent the foremost hanger from falling out the front of the chute or striking the boots and hanger immediately in the front thereof.

In order to retrieve the pair of boots mounted on the foremost hanger of a chute, dispensing individual 66, seen in FIG. 2, reaches in and grasps support member 24, lifting roller 26 out of rail channel 24 and over stop member 25 at the front of rail channel 24 and removing the entire hanger with boots resting on the first and second arms thereof from the chute. The boots are then removed from the hanger and dispensed as desired. The next adjacent hanger/boot assembly will then roll into the foremost position with its roller 26 then positioned against stop member 25. Along the bottom of each chute between first lower side wall 46 and second lower side wall 44 can be heater 42 having a plurality of apertures 31 defined therein to allow heat to rise therefrom which heat would heat such boots and aid in their drying. Heater 42 is an optional feature which can be powered by electricity or other means of providing heated air such as from a remote heat source.

In FIG. 2 is seen a plurality of chutes such as chutes 52 and 54 adjacent to chute 10. It can be seen from edge chute 56 that it extends rearwardly at an upward angle to where a loading individual 62 can position a hanger with boots mounted thereon within the appropriate chute. Each chute can be designated to receive boots of a particular size so that only boots of that size will be positioned in that chute. The sizes can be identified from both the front and rear of the chute so that the dispensing individual 66 can go to the appropriate chute for the boot size requested by the intended user. The requested boots can be dispensed to such user at counter 68. The hanger can then be reused with a returned pair of boots mounted thereon and the hanger engaged into the rail channel of the carriage assembly at the rear of the appropriate chute. The angle at which the chutes are disposed can be adjusted such as by an angle adjustment member 58 which can position the chutes at an angle of incline 60 so that they are sloped forward sufficiently to cause the hangers to roll forward by the force of gravity to advance the hangers with boots mounted thereon down each rail channel. The chutes can be disposed at approximately a 5-degree angle which angle of incline has been found to work well. In some embodiments of the system of this invention the sizes designation on centermost chutes can be determined by frequency of request for particular sizes of boots, for example, the most popular boot sizes would be designated for the middle chutes of the honeycomb-like structure and the less frequently requested sizes would be grouped to the sides of the structure to reduce the amount of walking of the dispenser or loader to obtain each requested pair of boots. It is estimated that a grouping of the chutes of this invention occupying a space that is 10 ft×11 ft×14 can hold 1300 pairs of ski boots in a very orderly and systematic fashion and provide easy retrieval with optional assisted drying of the boots.

Although the present invention has been described with reference to particular embodiments, it will be apparent to those skilled in the art that variations and modifications can be substituted therefor without departing from the principles and spirit of the invention.

We claim:

1. A ski boot storage, retrieval and drying device for use with pairs of ski boots of the type having toe portions, comprising:

a plurality of chutes, each chute being diamond-shaped in cross-section, each chute having a length, a front end, a rear end, an inner top and an apex defined along said length at said inner top of said chute, each of said chutes disposed at an angle with said rear end of each chute being higher than said front end, each of said chutes having a first upper side wall, a second upper side wall, a first lower side wall and a second lower side wall forming said diamond shape, said chutes being arranged in a honeycomb-like structure;

a carriage assembly disposed along said apex of each of said chutes;

a rail channel defined in said carriage assembly, said rail channel having a front end, a rear end and a stop member disposed at said front end;

at least one hanger having a top portion, a bottom portion and a vertical support member disposed between said top portion and said bottom portion, said top portion slideably and removably engageable in said rail channel in said carriage assembly; and a first arm and a second arm, each extending upward from said bottom portion, said first and second arms adapted to receive a pair of said ski boots, said ski boots mounted upside down on said first and second arms with said toe portions of said ski boots pointing inward and upward toward said carriage assembly whereby a pair of ski boots mounted on a hanger can be slid downward from the rear of a chute toward the front of the chute where they can be taken when they reach the front of said chute, when needed.

2. A ski boot storage, retrieval and drying device for use with pairs of ski boots of the type having toe portions, comprising:

a plurality of chutes, each chute being diamond-shaped in cross-section, each chute having a length, a front end, a rear end, an inner top and an apex defined along said length at said inner top of said chute, each of said chutes disposed at an angle with said rear end of each chute being higher than said front end, each of said chutes having a first upper side wall, a second upper side wall, a first lower side wall and a second lower side wall forming said diamond shape, said chutes being arranged in a honeycomb-like structure;

a carriage assembly disposed along said apex of each of said chutes;

a rail channel defined in said carriage assembly, said rail channel having a front end, a rear end and a stop member disposed at said front end;

at least one hanger having a top portion, a bottom portion and a vertical support member disposed between said top portion and said bottom portion, said top portion slideably and removably engageable in said rail channel in said carriage assembly;

a first arm and a second arm, each extending upward from said bottom portion, said first and second arms adapted to receive a pair of said ski boots, said ski boots mounted upside down on said first and second arms with said toe portions of said ski boots pointing inward and upward toward said carriage assembly whereby a pair of ski boots mounted on a hanger can be slid downward from the rear of a chute toward the front of the chute where they can be taken when they reach the front of said chute, when needed; and means to provide heated air within said plurality of chutes.

3. The device of claim 1 wherein said first and second arms are disposed, respectively, substantially parallel to said first lower side wall and said second lower side wall.

* * * * *